US011504826B2

(12) United States Patent
Su

(10) Patent No.: US 11,504,826 B2
(45) Date of Patent: Nov. 22, 2022

(54) QUICK-TURNING WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 356 days.

(21) Appl. No.: 16/857,438

(22) Filed: Apr. 24, 2020

(65) Prior Publication Data

US 2020/0398405 A1 Dec. 24, 2020

(30) Foreign Application Priority Data

Jun. 19, 2019 (TW) ..... 108121363

(51) Int. Cl.
*B25B 13/08* (2006.01)

(52) U.S. Cl.
CPC ..... *B25B 13/08* (2013.01)

(58) Field of Classification Search
CPC ..... B25B 13/08; B25B 13/46; B25B 13/065
See application file for complete search history.

(56) References Cited

U.S. PATENT DOCUMENTS 2,652,735 A * 9/1953 Wilder ..... B25B 13/46 81/119
3,620,107 A * 11/1971 Evans ..... B25B 13/46 D8/28
3,762,244 A * 10/1973 Evans ..... B25B 13/08 81/119
3,881,377 A * 5/1975 Evans ..... B25B 13/08 81/186
3,921,476 A * 11/1975 Evans ..... B25B 13/08 81/119
4,889,020 A * 12/1989 Baker ..... B25B 13/08 81/186
5,953,968 A * 9/1999 Macor ..... B25B 13/46 81/186
6,082,228 A * 7/2000 Macor ..... B25B 13/08 81/186

(Continued)

FOREIGN PATENT DOCUMENTS

TW M414298 U 10/2011
TW M456257 U 7/2013

(Continued)

*Primary Examiner* — David B. Thomas
(74) *Attorney, Agent, or Firm* — Alan D. Kamrath; Karin L. Williams; Mayer & Williams PC

(57) ABSTRACT

A quick-turning wrench includes a driving end with a first jaw and a second jaw. The first and the second jaws respectively have a first and a second side, which face one another. The driving end defines an engaging space between the first and the second jaws. The driving end has a first grip-surface section, a second grip-surface section, and a third grip-surface section. The engaging space is partially delimited by the first, the second, and the third grip-surface sections. The first grip-surface section is adjacent to the first side and extends along a flat first phantom surface. The second and the third grip-surface sections are adjacent to the second side and respectively extend on a flat second phantom surface and a flat third phantom surface.

12 Claims, 10 Drawing Sheets

(56) References Cited

U.S. PATENT DOCUMENTS

| | | | | |
|---|---|---|---|---|
| 6,158,309 | A * | 12/2000 | Baker | B25B 13/08 81/186 |
| 6,267,028 | B1 * | 7/2001 | Macor | B25B 13/08 81/186 |
| 6,289,772 | B1 * | 9/2001 | Ying-Wen | B25B 13/08 81/186 |
| 7,117,770 | B2 * | 10/2006 | Hsien | B25B 13/46 81/186 |
| 8,973,471 | B2 * | 3/2015 | Hsieh | B25B 13/04 81/186 |
| 9,592,590 | B2 | 3/2017 | Chen et al. | |
| 2008/0156150 | A1 | 7/2008 | Wright et al. | |
| 2012/0297936 | A1 * | 11/2012 | Chen | B25B 13/08 81/119 |
| 2013/0192428 | A1 * | 8/2013 | Chen | B25B 13/46 81/119 |

FOREIGN PATENT DOCUMENTS

| | | |
|---|---|---|
| TW | M483145 U | 8/2014 |
| TW | M575751 U | 3/2019 |

* cited by examiner

QUICK-TURNING WRENCH

BACKGROUND OF THE INVENTION

1. Field of the Invention

The present invention relates to a wrench and, particularly, to quick-turning wrench.

2. Description of the Related Art

TW Pat. No. M483145 is directed to an open-end ratcheting wrench. The wrench includes a body, a pawl and a spring. The body has a handle section adapted to be grasped during the operation of the wrench, a driving section adapted to engage with an object to be driven by the wrench, a throat section extending between the handle section and the driving section, and two jaw sections adapted to cooperate to hold the object by the wrench. The two jaws respectively extend from the right side and the left side of the throat section. One of the jaw defines a slot. The slot receives the pawl and the spring. The pawl is retained in the slot and urged by the spring. The pawl is movable and in the slot. Specifically, when the wrench engaging with the object is turned clockwise, it can move relative to the object, and the pawl is reciprocally moved by the object; and when the wrench is turned counterclockwise, the object is rotatably driven by the wrench, and the pawl is restrained from movement and pushed by the object.

Although the wrench enables a user to turn the object more quickly than using conventional open-end wrenches, the manufacture of such wrench is relatively complex, and the cost is relatively expensive. Another problem is that the pawl can get jammed.

The present invention is, therefore, intended to obviate or at least alleviate the problems encountered in the prior art.

SUMMARY OF THE INVENTION

According to the present invention, a quick-turning wrench includes a driving end with a first jaw and a second jaw. The first and the second jaws respectively have a first and a second side, which face one another. The driving end defines an engaging space between the first and the second jaws. The driving end has a first grip-surface section, a second grip-surface section, and a third grip-surface section configured for gripping the object to be driven by the quick-turning wrench. The engaging space is partially delimited by the first, the second, and the third grip-surface sections. The first grip-surface section is adjacent to the first side and extends along a flat first phantom surface. The second and the third grip-surface sections are adjacent to the second side and respectively extend along a flat second phantom surface and a flat third phantom surface. The first phantom surface and the second phantom surface intersect with one another and have a first angle defined therebetween greater than 50 degrees and less than 85 degrees. The second phantom surface and the third phantom surface intersect with one another and have a second angle defined therebetween greater than 90 degrees and less than 130 degrees. The first phantom surface and the third phantom surface intersect with one another and have a third angle defined therebetween greater than 1 degrees and less than 40 degrees.

According to another preferred embodiment of this invention, a quick-turning wrench includes a driving end with a first jaw and a second jaw. The first and the second jaws respectively have a first and a second side, which face one another. The driving end defines an engaging space between the first and the second jaws. The driving end has a first grip-surface section, a second grip-surface section, a third grip-surface section, and a fourth grip-surface section configured for gripping the object to be driven by the quick-turning wrench. The engaging space is partially delimited by the first, the second, the third, and the fourth grip-surface sections. The first and the second grip-surface sections are adjacent to the first side and respectively extend along a flat first phantom surface and a flat second phantom surface. The third and the fourth grip-surface sections are adjacent to the second side and respectively extend along a flat third phantom surface and a flat fourth phantom surface. The first phantom surface and the second phantom surface intersect with one another and have a first angle defined therebetween greater than 100 degrees and less than 150 degrees. The third phantom surface and the fourth phantom surface intersect with one another and have a second angle defined therebetween greater than 100 degrees and less than 150 degrees.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
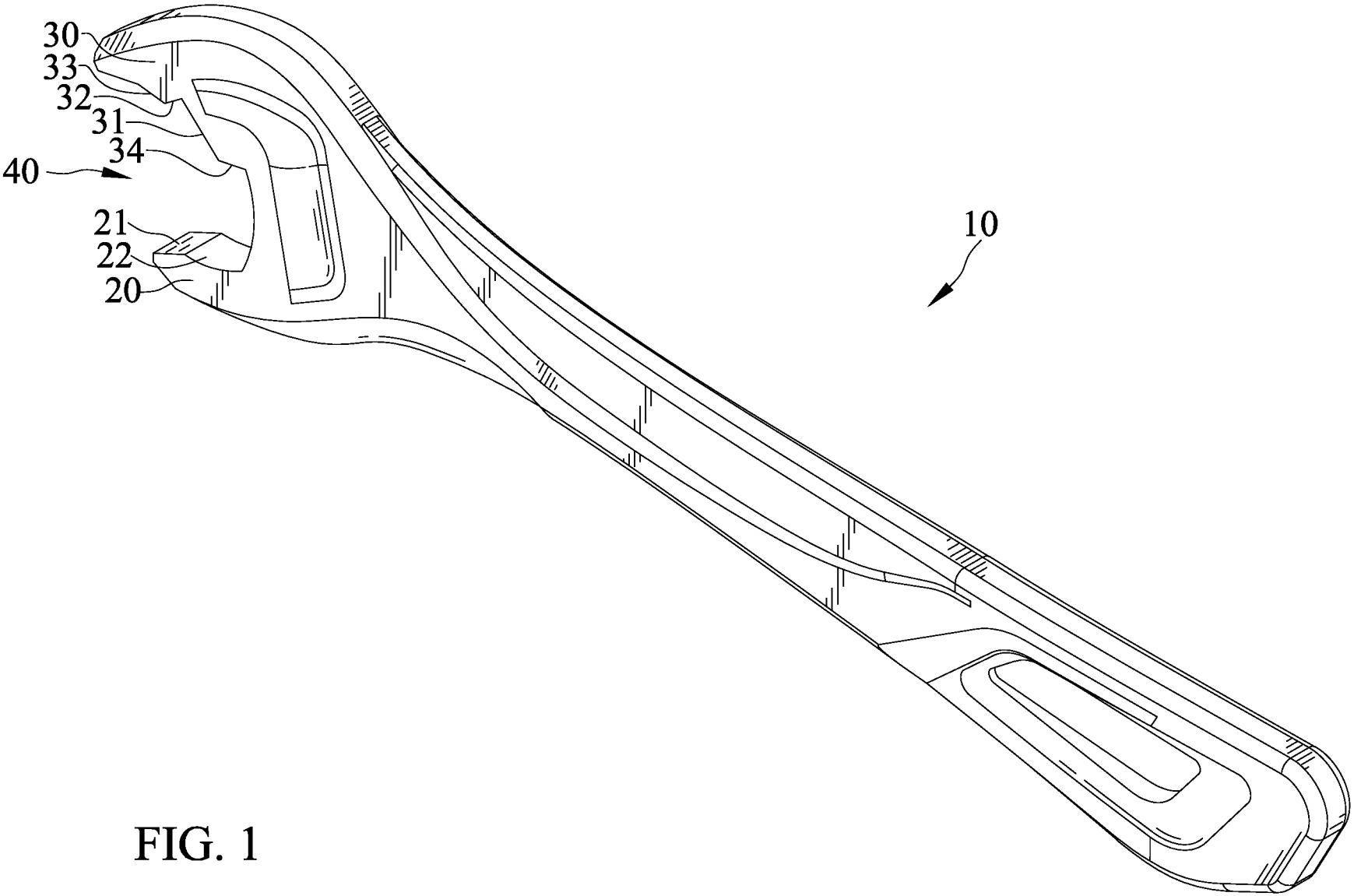
FIG. 1 is a perspective view of a quick-turning wrench in accordance with a first embodiment of the present invention.
Figure 2:
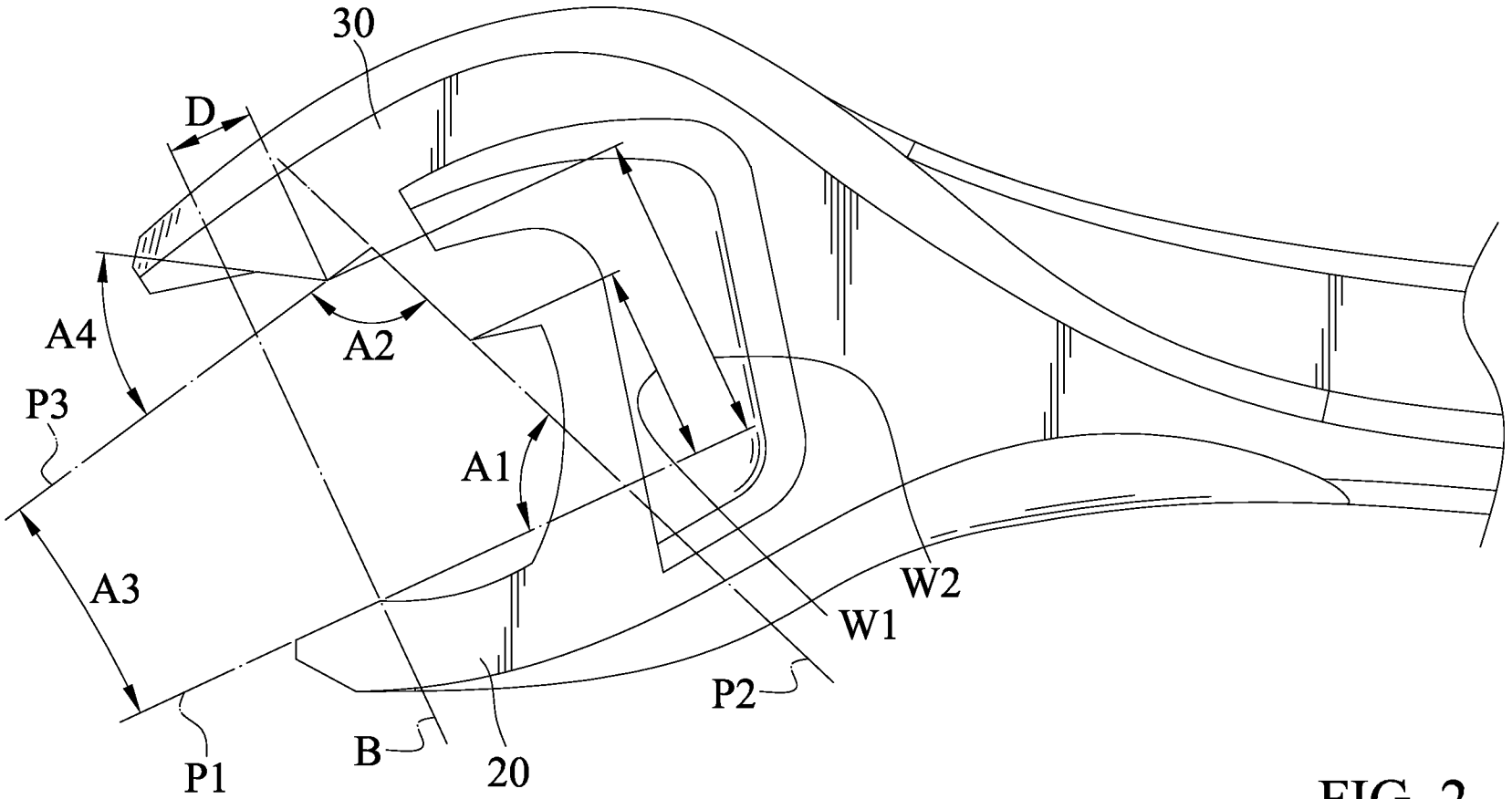
FIG. 2 is a partial, enlarged top view of the quick-turning wrench of FIG. 1.

FIGS. 1 through 5 show a quick-turning wrench 10 in accordance with a first embodiment of the present invention.

The quick-turning wrench 10 has a driving end with a jaw 20 and a jaw 30. The jaws 20 and 30 respectively have a first and a second side, which face one another. The jaws 20 and 30 are configured to grip an object to be driven therebetween. The jaws 20 and 30 are fixed jaws. The driving end defines an engaging space 40 between the jaws 20 and 30. The engaging space 40 is configured to accommodate the object to be driven by the quick-turning wrench 10. The quick-turning wrench 10 is an open-end wrench.

The driving end has a grip-surface section 21, a grip-surface section 31, and a grip-surface section 32 configured for gripping the object to be driven by the quick-turning wrench 10. The engaging space 40 is partially delimited by the grip-surface sections 21, 31, and 32. The grip-surface section 21 is adjacent to the first side of the jaw 20 and extends along a flat phantom surface P1. The grip-surface sections 31 and 32 are adjacent to the second side of the jaw 30 and respectively extend along a flat phantom surface P2 and a flat phantom surface P3. The grip-surface section 31, as it extends away from the grip-surface section 32, approaches the phantom surface P1. The grip-surface section 32, as it extends away from the grip-surface section 31, approaches the phantom surface P1. The grip-surface sections 21, 31, 32 are flat surfaces.

The phantom surface P1 and the phantom surface P2 intersect with one another and have an angle A1 defined therebetween greater than 50 degrees and less than 85 degrees. Preferably, the angle A1 is greater than 65 degrees and less than 75 degrees. The phantom surface P2 and the phantom surface P3 intersect with one another and have an angle A2 defined therebetween greater than 90 degrees and less than 130 degrees. Preferably, the angle A2 is greater than 90 degrees and less than 105 degrees. The phantom surface P1 and the phantom surface P3 intersect with one another and have an angle A3 defined therebetween greater than 1 degrees and less than 40 degrees. Preferably, the angle A3 is greater than 10 degrees and less than 15 degrees.

Figure 3:
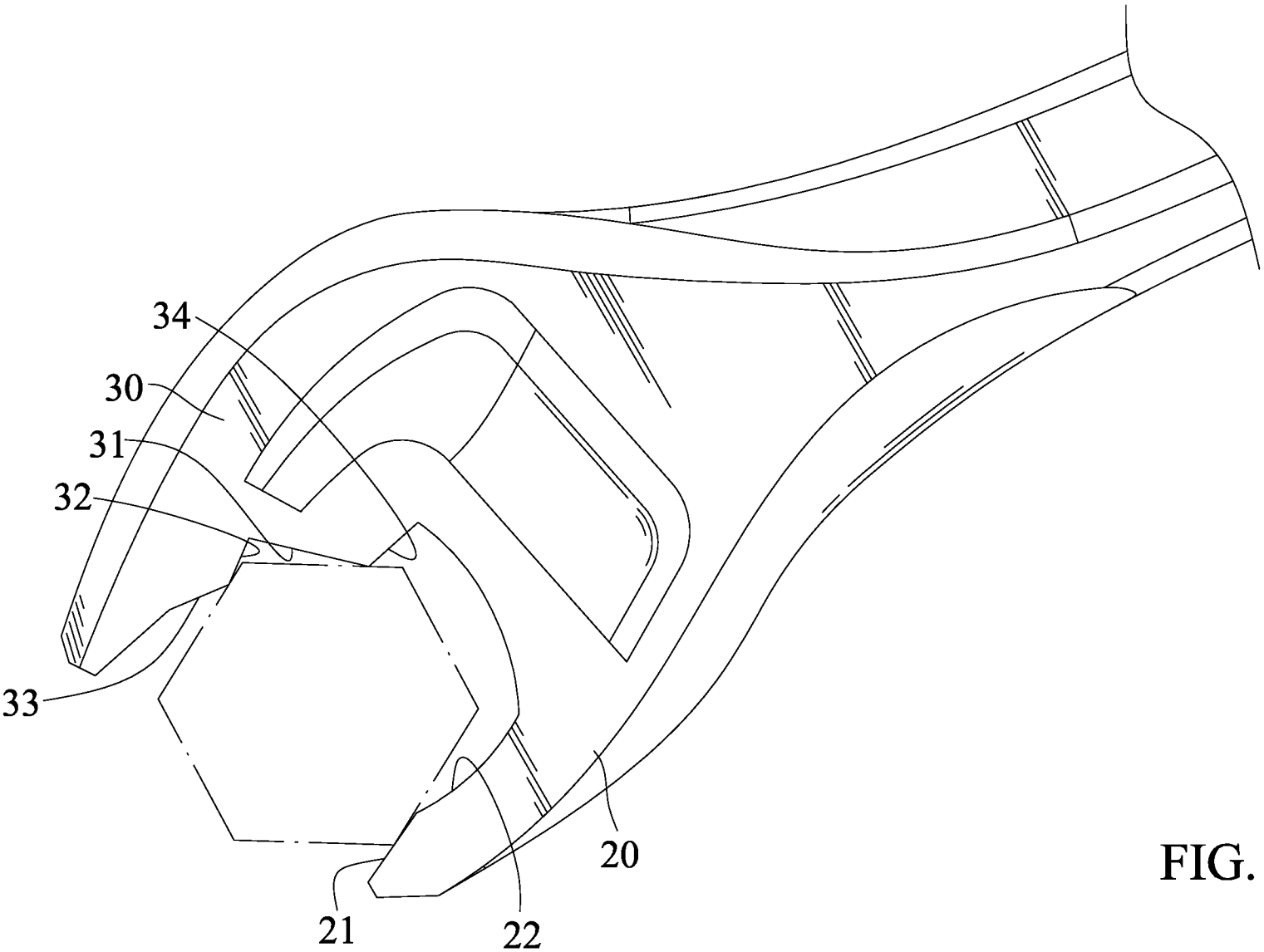
FIG. 3 illustrates the quick-turning wrench of FIG. 1 engaging with an object to be driven.
Figure 4:
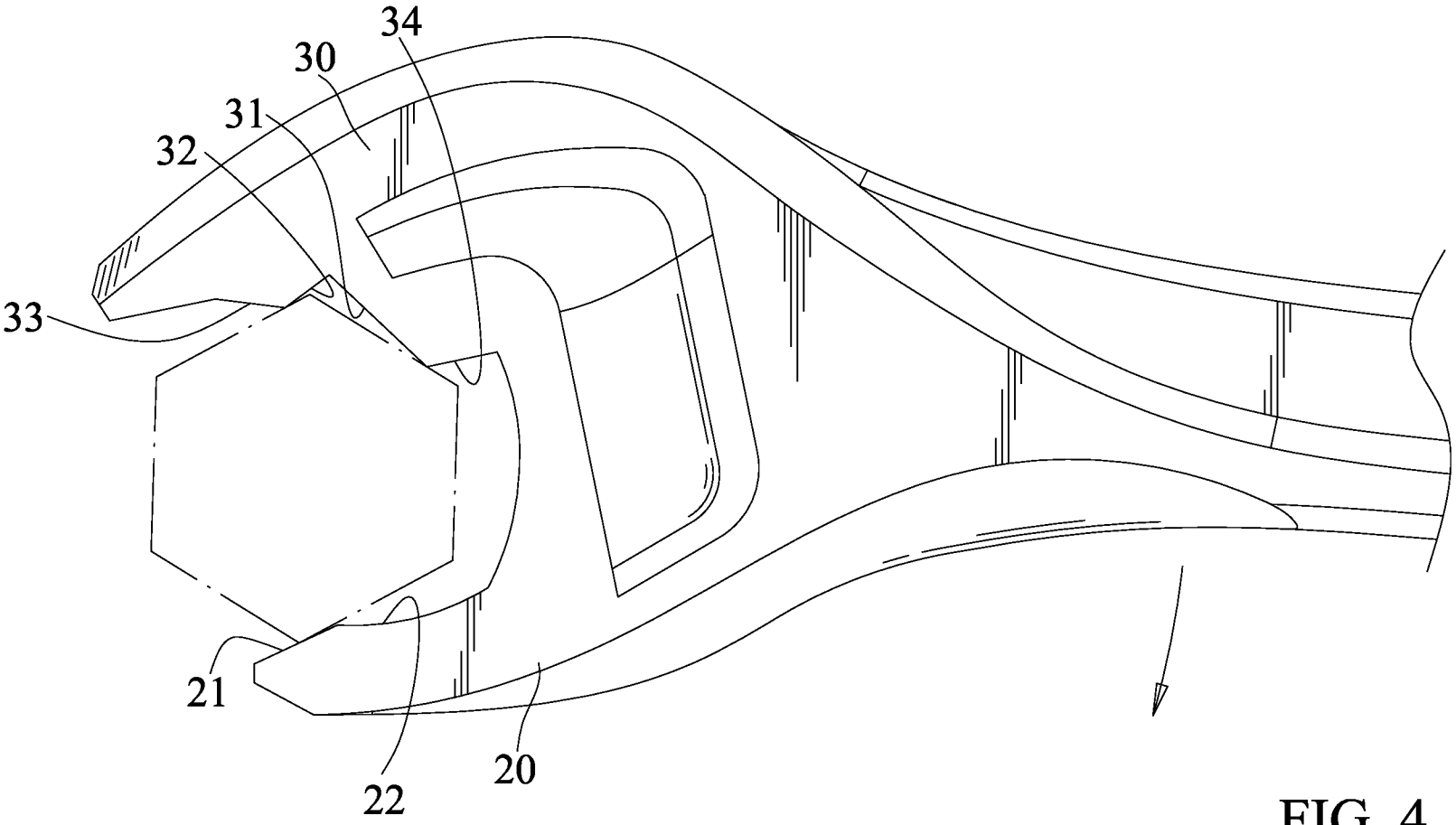
FIG. 4 illustrates the object to be driven being turned after turning the quick-turning wrench of FIG. 1 in a first direction.

The driving end has a surface section 22, a second surface section 33, and a surface section 34. Each of the surface sections 22, 33, and 34 is in a form of a recess and free of contact with the object to be driven when the object to be driven is driven by the quick-turning wrench 10, as shown in FIGS. 3 and 4. The engaging space 40 is partially delimited by the surface sections 22, 33, and 34. The surface section 22 is adjacent to the grip-surface section 21. The surface section 22, as it extends away from the grip-surface section 21, moves away from an open distal end of the quick-turning wrench 10, which allows the object to be driven to be inserted into the engaging space 40. The surface sections 22 is in a form of a curved recess. The surface section 33 is adjacent to the grip-surface section 32. The surface section 33 has a segment adjacent to grip-surface section 32. The segment is flat. The segment is tilted from the phantom surface P3 at an angle A4 greater than 35 degrees and less than 50 degrees. Preferably, the angle A4 is greater than 40 degrees and less than 45 degrees. The surface section 33 has another segment orientated differently from the segment. Another segment, as it extends away from the segment, moves away from the phantom surface P1. Another segment is flat. The surface section 34 is adjacent to the grip-surface section 31.

The grip-surface section 31 and the phantom surface P1 has a minimum distance therebetween defining a width W1. The grip-surface section 32 and the phantom surface P1 has a minimum distance therebetween defining a width W2. The width W1 is greater than 0.55 times of the second width W2 and less than 0.7 times of the second width W2. Preferably, the width W1 is greater than 0.6 times of the width W2 and less than 0.65 times of the width W2.

The grip-surface section 21 is perpendicular to a phantom axis B. The phantom axis B does not intersect with the surface sections 33 and 34. The grip-surface section 21 terminates at the phantom axis B. The grip-surface section 32 and the phantom axis B has a minimum distance therebetween defining a depth D greater than 0.2 times of the width W2 and less than 0.35 times of the width W2. Preferably, the depth D is greater than 0.25 times of the width W2 and less than 0.3 times of the width W2.

Figure 5:
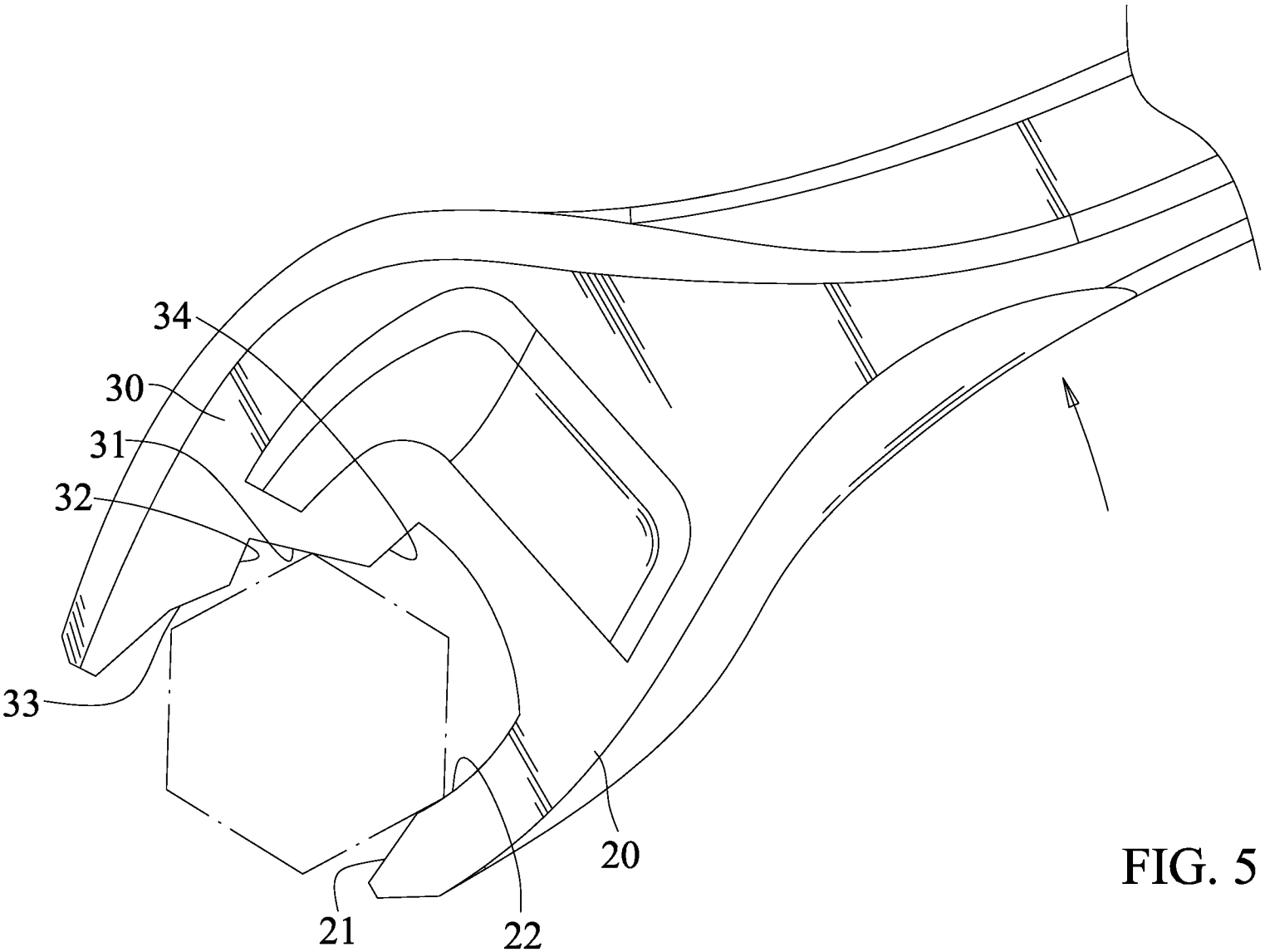
FIG. 5 illustrates the quick-turning wrench of FIG. 1. turned in a second direction moving relative to the object to be driven.
Figure 6:
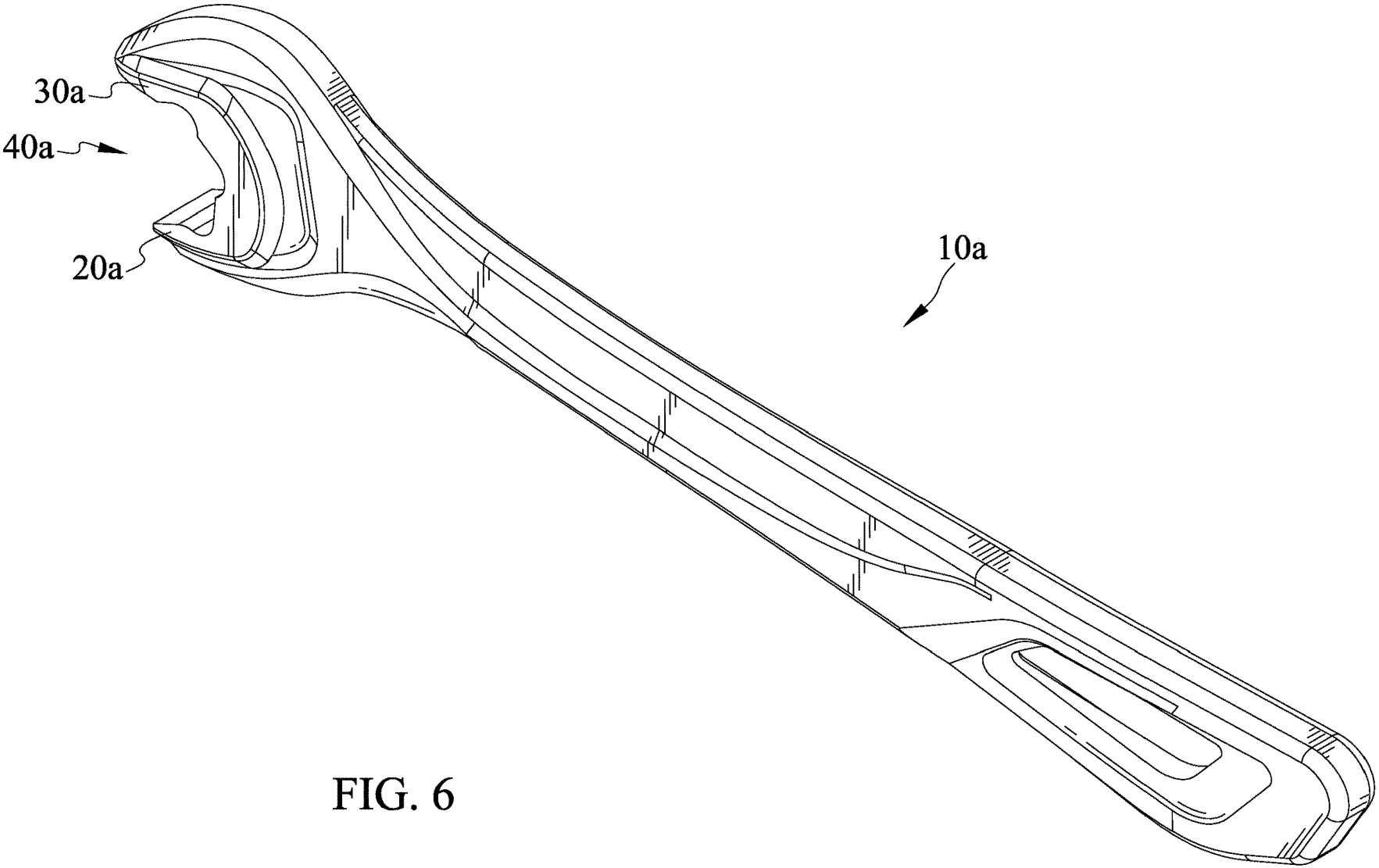
FIG. 6 is a perspective view of a quick-turning wrench in accordance with a second embodiment of the present invention.
Figure 7:
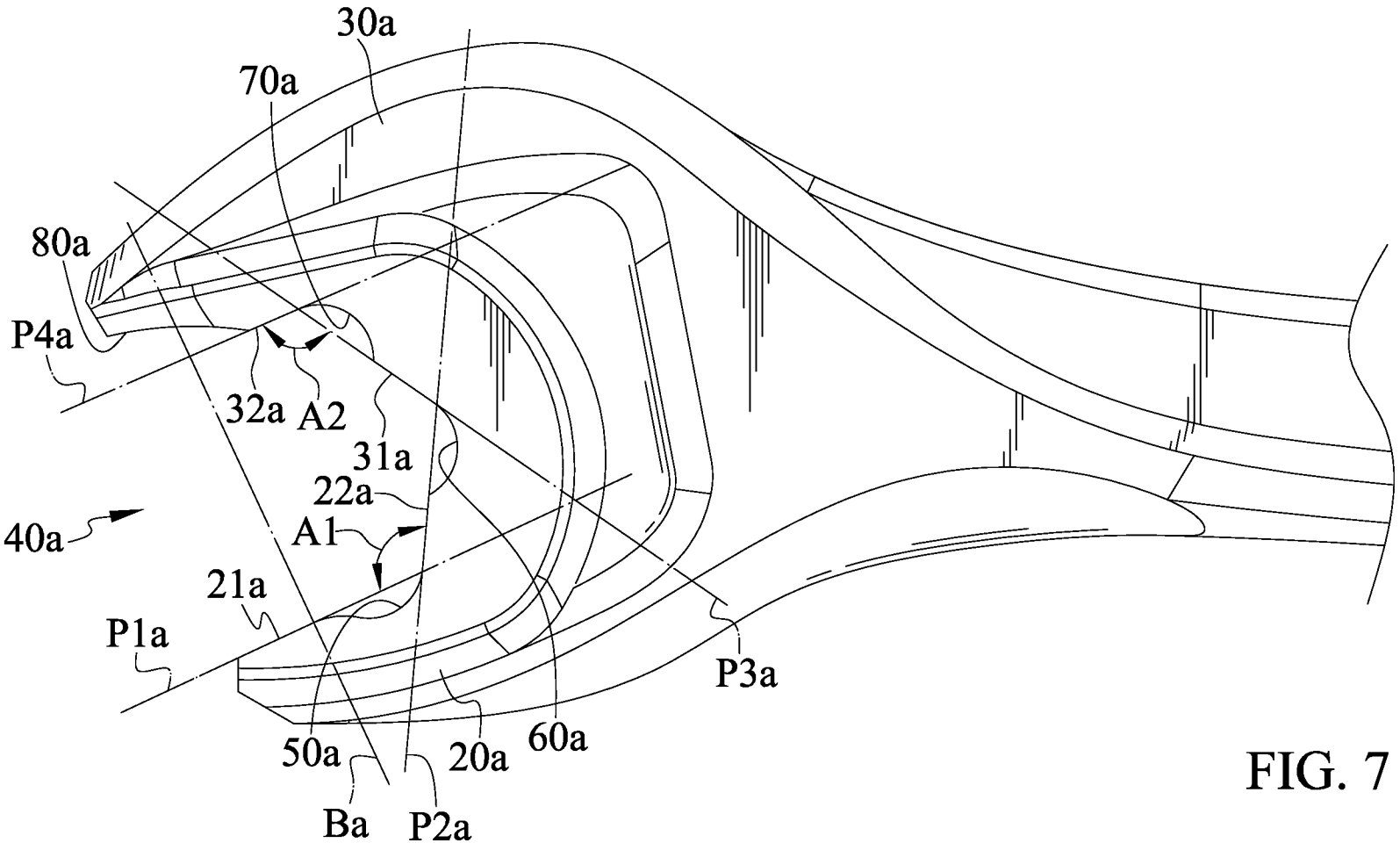
FIG. 7 is a partial, enlarged top view of the quick-turning wrench of FIG. 6.

Furthermore, FIGS. 4 and 5 illustrate the quick-turning wrench 10 turned in a direction different from that of FIG. 4 can move relative to the object to be driven.

FIGS. 6 through 10 show a quick-turning wrench 10*a* in accordance with a second embodiment of the present invention, and the same numbers are used to correlate similar components of the first embodiment, but bearing a letter a.

The quick-turning wrench 10*a* has a driving end with a jaw 20*a* and a jaw 30*a*. The jaws 20*a* and 30*a* respectively have a first and a second side, which face one another. The driving end defines an engaging space 40*a* between the jaws 20*a* and 30*a*.

The driving end has a grip-surface section 21*a*, a grip-surface section 22*a*, a grip-surface section 31*a*, and a grip-surface section 32*a* configured for gripping the object to be driven by the quick-turning wrench 10*a*. The engaging space 40*a* is partially delimited by the grip-surface sections 21*a*, 22*a*, 31*a*, and 32*a*. The grip-surface sections 21*a* and 22*a* are adjacent to the first side of the jaw 20*a* and respectively extend along a flat phantom surface P1*a* and a flat phantom surface P2*a*. The grip-surface sections 31*a* and 32*a* are adjacent to the second side of the jaw 30*a* and respectively extend along a flat phantom surface P3*a* and a flat phantom surface P4*a*. The grip-surface sections 21*a*, 31*a*, 32*a* are flat surfaces.

The phantom surface P1*a* and the phantom surface P2*a* intersect with one another and have an angle A1 defined therebetween greater than 100 degrees and less than 150 degrees. The phantom surface P3*a* and the phantom surface P4*a* intersect with one another and have an angle A2 defined therebetween greater than 100 degrees and less than 150 degrees.

Figure 8:
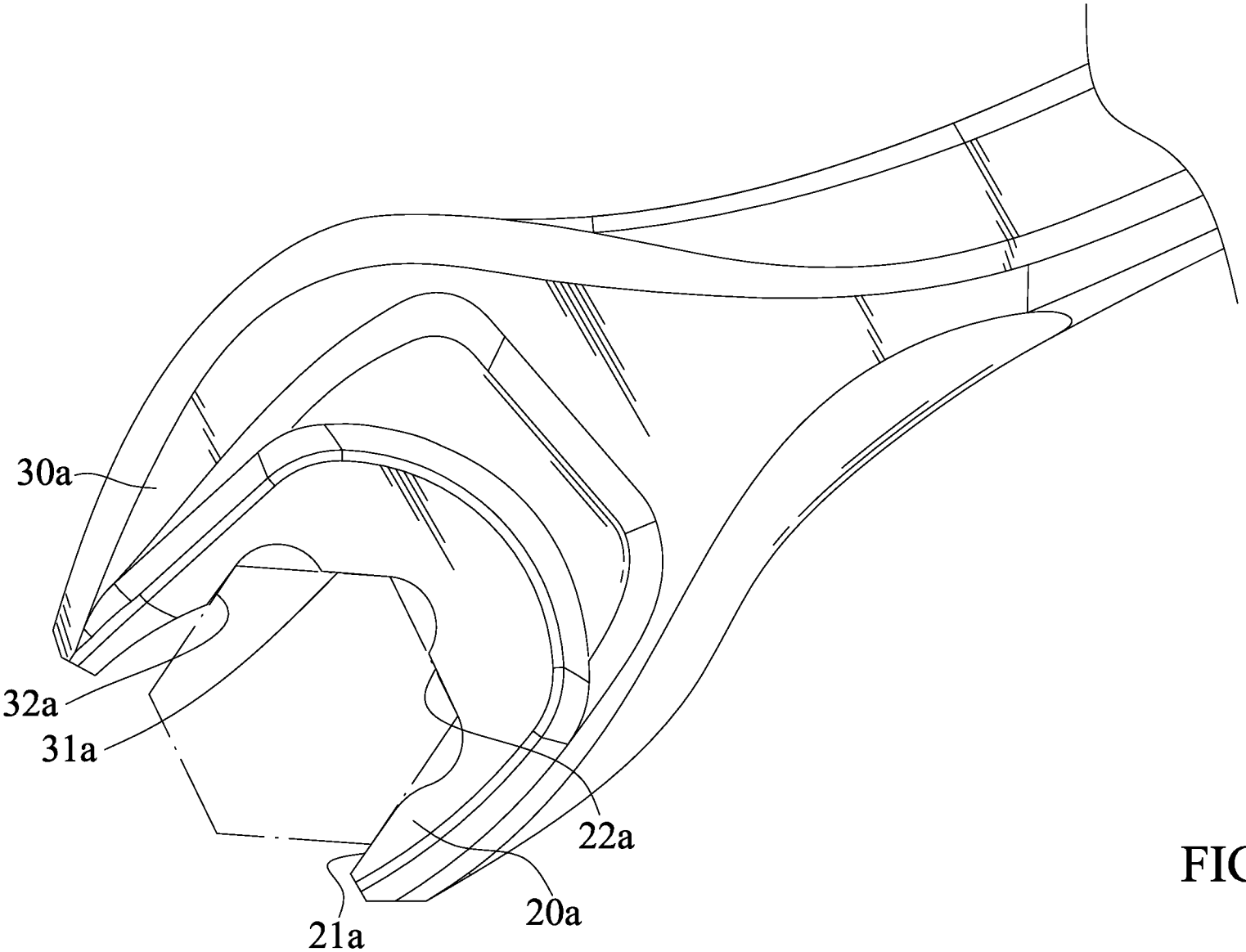
FIG. 8 illustrates the quick-turning wrench of FIG. 6 engaging with an object to be driven.
Figure 9:
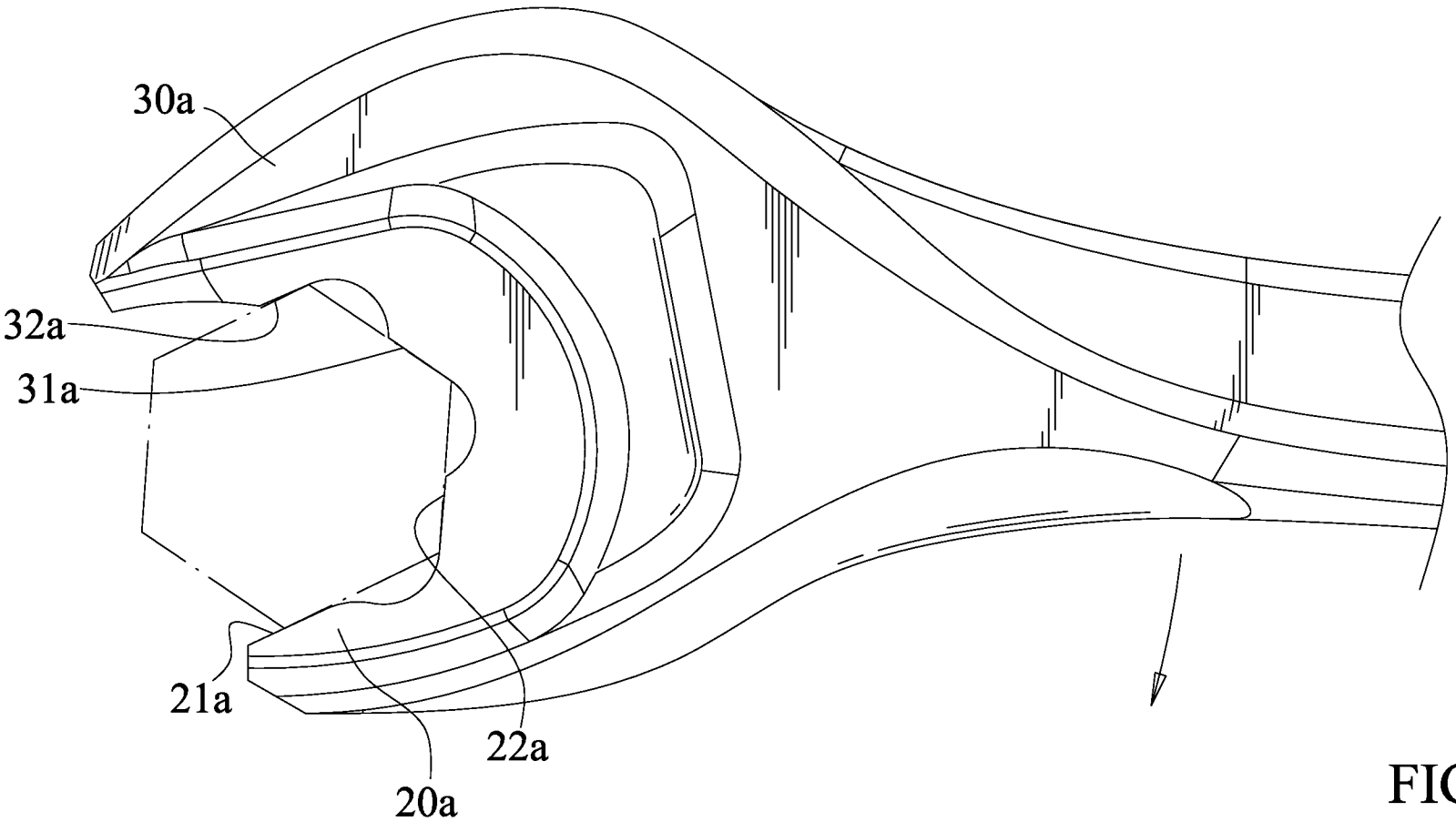
FIG. 9 illustrates the object to be driven being turned after turning the quick-turning wrench of FIG. 6 in a first direction.

The driving end has a surface section 50*a*, a surface section 60*a*, a surface section 70*a*, and a surface section 80*a*. Each of the surface sections 50*a*, 60*a*, 70*a*, and 80*a* is in a form of a recess and free of contact with the object to be driven when the object to be driven is driven by the quick-turning wrench 10*a*, as shown in FIGS. 8 and 9. The engaging space 40*a* is partially delimited by the surface sections 50*a*, 60*a*, 70*a*, and 80*a*. The surface section 50*a* is adjacent to the grip-surface section 22*a*. The surface section 50*a* is disposed between the grip-surface sections 21*a* and 22*a*. The surface section 60*a* is adjacent to the grip-surface section 31*a*. The surface section 60*a* is disposed between the grip-surface section 22*a* and 31*a*. The surface section 70*a* is adjacent to the grip-surface section 32*a*. The surface section 70*a* is disposed between the grip-surface sections 31*a* and 32*a*. Each of the surface sections 50*a*, 60*a*, and 70*a* is in a form of a curved recess. The surface section 50*a* is tangential to the phantom surface P2*a*. The surface section 60*a* is tangential to the phantom surface P3*a*. The surface section 70*a* is tangential to the fourth phantom surface P4*a*. The surface section 80*a* is adjacent to an end of the grip-surface section 32*a* different from the surface section 70*a*. The surface section 80*a*, as it extends away from the grip-surface section 32*a*, moves away from the first phantom surface P1*a*. The surface section 80*a* is in a form of a curved recess.

The grip-surface section 21*a* is perpendicular to a phantom axis Ba. The grip-surface section 21*a* terminates at the phantom axis Ba. The phantom axis Ba does not intersect with the third and the fourth grip-surface sections 31*a* and 32*a*.

Figure 10:
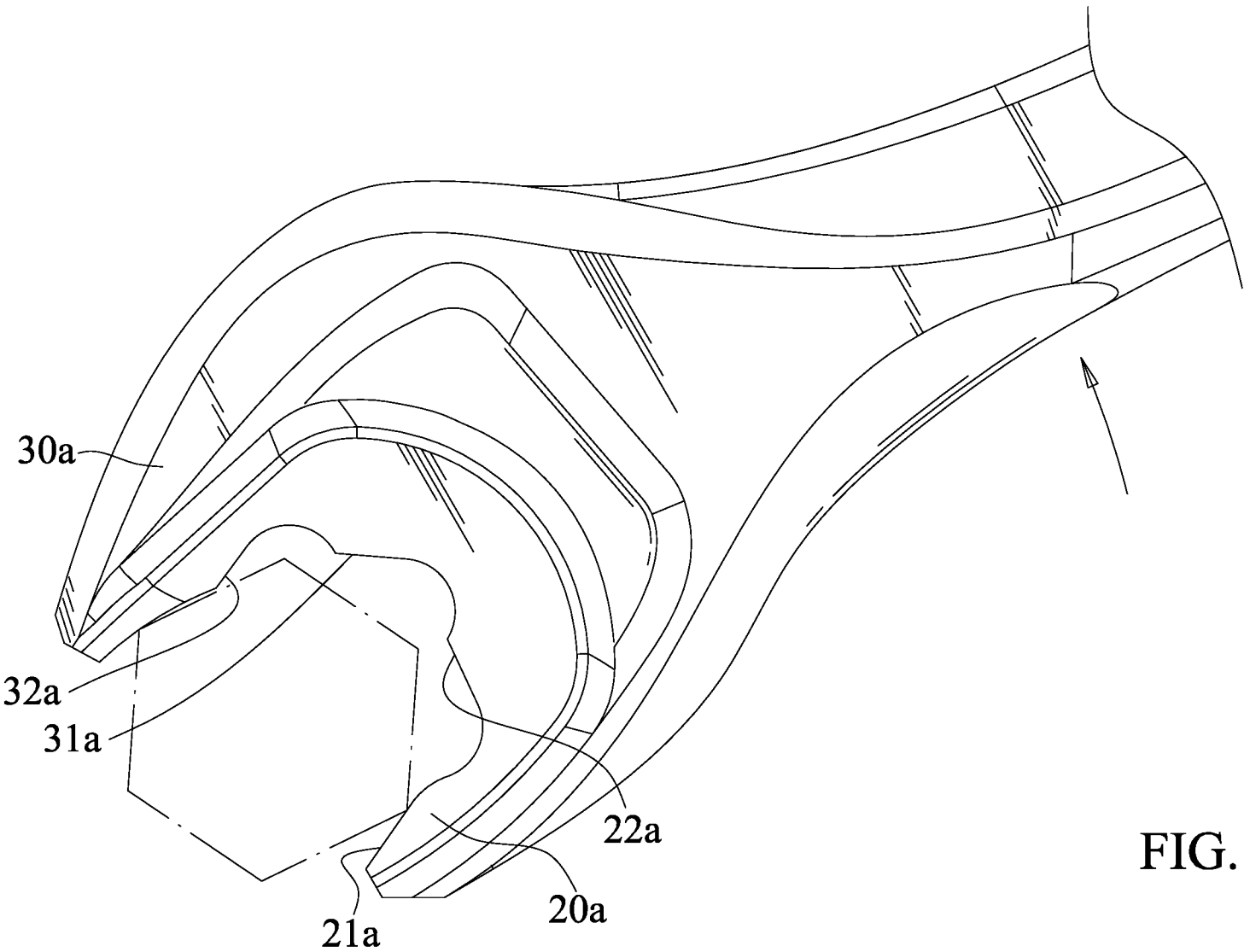
FIG. 10 illustrates the quick-turning wrench of FIG. 6. turned in a second direction moving relative to the object to be driven.

Furthermore, FIGS. 9 and 10 illustrate the quick-turning wrench 10 turned in a direction different from that of FIG. 9 can move relative to the object to be driven.

In view of the foregoing, the quick-turning wrench 10 according to the first embodiment of the present invention includes the grip-surface sections 21, 31, and 32 extending along the flat phantom surfaces P1, P2, and P3. The phantom surfaces P1, P2, and P3 are designed to extend on specific directions and to have specific relationships therebetween, for allowing a user to operate the wrench 10 in a first rotational direction to drive an object to be driven and in a second rotational direction, which is opposite to the first rotation direction. Thus, the user can operate the quick-turning wrench 10 to drive the object to be driven quickly. Specifically, the angle A1 is greater than 50 degrees and less than 85 degrees, the angle A2 is greater than 90 degrees and less than 130 degrees, and the angle A3 is greater than 1 degrees and less than 40 degrees.

According to the second embodiment of the present invention, the quick-turning wrench 10*a* includes the grip-surface sections 21*a*, 22*a*, 31*a*, and 32*a* extending along the flat phantom surfaces P1*a*, P2*a*, P3*a*, and P4*a*. The phantom surfaces P1*a*, P2*a*, P3*a*, and P4*a* are designed to extend on specific directions and to have specific relationships therebetween, for allowing a user to operate the wrench 10*a* in a first rotational direction to drive an object to be driven and in a second rotational direction, which is opposite to the first rotation direction. Thus, the user can operate the quick-turning wrench 10*a* to drive the object to be driven quickly. Specifically, the angle A1 is greater than 100 degrees and less than 150 degrees, and the angle A2 is greater than 100 degrees and less than 150 degrees.

The foregoing is merely illustrative of the principles of this invention and various modifications can be made by those skilled in the art without departing from the scope and spirit of the invention.

What is claimed is:

1. A quick-turning wrench comprising:

a driving end with a first jaw and a second jaw, wherein the first and the second jaws respectively have a first and a second side, which face one another, wherein the driving end defines an engaging space between the first and the second jaws, wherein the driving end has a first grip-surface section, a second grip-surface section, and a third grip-surface section configured for gripping the object to be driven by the quick-turning wrench, wherein the engaging space is partially delimited by the first, the second, and the third grip-surface sections, wherein the first grip-surface section is adjacent to the first side and extends along a flat first phantom surface, wherein the second and the third grip-surface sections are adjacent to the second side and respectively extend along a flat second phantom surface and a flat third phantom surface, wherein the first phantom surface and the second phantom surface intersect with one another and have a first angle defined therebetween greater than 50 degrees and less than 85 degrees, wherein the second phantom surface and the third phantom surface intersect with one another and have a second angle defined therebetween greater than 90 degrees and less than 130 degrees, and wherein the first phantom surface and the third phantom surface intersect with one another and have a third angle defined therebetween greater than 1 degrees and less than 40 degrees.

2. The quick-turning wrench as claimed in claim 1, wherein the driving end has a first surface section, a second surface section, and a third surface section, wherein each of the first, the second, and the third surface sections is in a form of a recess and free of contact with the object to be driven when the object to be driven is driven by the quick-turning wrench, wherein the engaging space is partially delimited by the first, the second, and the third surface sections, wherein the first surface section is adjacent to the first grip-surface section, wherein the second surface section is adjacent to the third grip-surface section, and wherein the third surface section is adjacent to the second grip-surface section.

3. The quick-turning wrench as claimed in claim 2, wherein the second surface section has a segment adjacent to second grip-surface section, wherein the segment is flat, and wherein the segment is tilted from the third phantom surface at a fourth angle greater than 35 degrees and less than 50 degrees.

4. The quick-turning wrench as claimed in claim 3, wherein the second surface section has another segment orientated differently from the segment, and wherein another segment, as it extends away from the segment, moves away from the first phantom surface.

5. The quick-turning wrench as claimed in claim 4, wherein the first surface sections is in a form of a curved recess.

6. The quick-turning wrench as claimed in claim 1, wherein the second grip-surface section, as it extends away from the third grip-surface section, approaches the first phantom surface, and wherein the third grip-surface section, as it extends away from the second grip-surface section, approaches the first phantom surface.

7. The quick-turning wrench as claimed in claim 6, wherein the second grip-surface section and the first phantom surface has a minimum distance therebetween defining a first width, wherein the third grip-surface section and the first phantom surface has a minimum distance therebetween defining a second width, and wherein the first width is greater than 0.55 times of the second width and less than 0.7 times of the second width.

8. The quick-turning wrench as claimed in claim 7, wherein the first grip-surface section is perpendicular to a phantom axis, wherein the first grip-surface section terminates at the phantom axis, and wherein the third grip-surface section and the phantom axis has a minimum distance therebetween defining a depth greater than 0.2 times of the second width and less than 0.35 times of the second width.

9. The quick-turning wrench as claimed in claim 8, wherein the phantom axis does not intersect with the second, and the third surface sections.

10. The quick-turning wrench as claimed in claim 8, wherein the driving end has a first surface section, a second surface section, and a third surface section, wherein each of the first, the second, and the third surface sections is in a form of a recess and free of contact with the object to be driven when the object to be driven is driven by the quick-turning wrench, wherein the engaging space is partially delimited by the first, the second, and the third surface sections, wherein the first surface section is adjacent to the first grip-surface section, wherein the second surface section is adjacent to the third grip-surface section, and wherein the third surface section is adjacent to the second grip-surface section.

11. The quick-turning wrench as claimed in claim 10, wherein the second surface section has a segment adjacent to second grip-surface section of the second jaw, wherein the segment is flat, and wherein the segment is tilted from the flat third phantom surface at a fourth angle greater than 35 degrees and less than 50 degrees.

12. The quick-turning wrench as claimed in claim 11, wherein the first angle is greater than 65 degrees and less than 75 degrees, wherein the second angle is greater than 90 degrees and less than 105 degrees, wherein the third angle is greater than 10 degrees and less than 15 degrees, wherein the fourth angle is greater than 40 degrees and less than 45 degrees, wherein the first width is greater than 0.6 times of the second width and less than 0.65 times of the second width, and wherein the depth is greater than 0.25 times of the second width and less than 0.3 times of the second width.

* * * * *